US010130990B2

(12) United States Patent
Shuto et al.

(10) Patent No.: US 10,130,990 B2
(45) Date of Patent: Nov. 20, 2018

(54) CASTING MOLD

(71) Applicant: HONDA MOTOR CO., LTD., Tokyo (JP)

(72) Inventors: Kenichi Shuto, Tochigi (JP); Masayuki Hattori, Tochigi (JP); Toshihiro Takahashi, Tochigi (JP); Hiroshi Takahashi, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/537,916

(22) PCT Filed: Dec. 24, 2015

(86) PCT No.: PCT/JP2015/086031
§ 371 (c)(1),
(2) Date: Jun. 20, 2017

(87) PCT Pub. No.: WO2016/104605
PCT Pub. Date: Jun. 30, 2016

(65) Prior Publication Data

US 2017/0348764 A1 Dec. 7, 2017

(30) Foreign Application Priority Data

Dec. 24, 2014 (JP) ..... 2014-260095

(51) Int. Cl.
*B22C 9/06* (2006.01)
*B22D 18/04* (2006.01)
(Continued)

(52) U.S. Cl.
CPC ..... *B22C 9/062* (2013.01); *B22D 17/20* (2013.01); *B22D 17/266* (2013.01); *B22D 18/04* (2013.01)

(58) Field of Classification Search
CPC ..... B22C 9/062; B22D 17/26; B22D 17/266; B22D 18/04; B29C 45/1742; B29C 45/1743
See application file for complete search history.

(56) References Cited

U.S. PATENT DOCUMENTS 7,766,072 B2 * 8/2010 Yokoyama ..... B22D 17/266 164/137
8,646,512 B2 * 2/2014 Layton ..... B22D 17/266 164/340
2006/0157217 A1 * 7/2006 Bassi ..... B22D 18/04 164/119

FOREIGN PATENT DOCUMENTS

GB 2208817 A * 4/1989 ..... B22C 9/061
JP 08-323459 12/1996
(Continued)

OTHER PUBLICATIONS

International Search Report, dated Jan. 26, 2016 (Jan. 26, 2016), 1 page.

*Primary Examiner* — Kevin E Yoon
(74) *Attorney, Agent, or Firm* — Rankin, Hill & Clark LLP

(57) ABSTRACT

Provided is a casting mold including a lower mold 4 fixed on a base 3, a plurality of horizontal sliding molds 5 to 8 which slide freely on the base 3 between a mold-opening position and a mold-closing position, an upper mold 9, and sliding mechanisms 12, 25 which slide the horizontal sliding molds 5 to 8 in the sliding directions. When sliding the horizontal sliding molds from the mold-opening position to the mold-closing position, the sliding mechanisms 12, 25 cause force to act on a lower section of the horizontal sliding molds 5 to 8 and prevent force from acting on an upper section of the horizontal sliding molds 5 to 8.

4 Claims, 4 Drawing Sheets

(51) Int. Cl.
*B22D 17/20* (2006.01)
*B22D 17/26* (2006.01)

(56) References Cited

FOREIGN PATENT DOCUMENTS

| | | | |
|---|---|---|---|
| JP | 2005-205437 | | 8/2005 |
| JP | 2008238181 A | * | 10/2008 |
| JP | 2013-086118 | | 5/2013 |

* cited by examiner

CASTING MOLD

TECHNICAL FIELD

The present invention relates to a casting mold including a lower mold fixed to a base and horizontal sliding molds which slide freely on the base.

BACKGROUND ART

Hitherto, it is known to cast a cylinder head of an engine for a vehicle by a low pressure die casting method. As a casting machine for this low pressure die casting method, it is known to adopt a configuration in which a molten metal furnace is arranged under a mold composed of an upper mold and a lower mold having a sprue, and the molten metal stored in the molten metal furnace is pushed up by applying pressure and supplied to the inside of the mold via a stoke (supply conduit) through the sprue of the lower mold.

In this type of casting machine, in a case of producing a product having a complicated shape which cannot be casted only by the upper mold and the lower mold, a horizontal sliding mold is used in addition to the upper mold and the lower mold (for example, refer to Japanese Patent Application Laid-open No. 2013-86118). As a casting machine using the horizontal sliding molds, there is known to arrange the horizontal sliding molds along the four sides of a rectangular lower mold so as to enable reciprocating motion while sliding on a rail between a mold-closing position and a mold-opening position. A lower section of the horizontal sliding mold closely contacts the lower mold, and the side section of the horizontal sliding mold closely contacts the adjacent horizontal sliding mold at the mold-closing position.

Here, the inside of the casting machine easily becomes high temperature at the lower side where the molten metal furnace is arranged, and therefore, the temperature of the lower mold tends to become higher compared to the horizontal sliding mold positioned upward with respect to the lower mold. Moreover, when the horizontal sliding mold is positioned at the mold-closing position, the lower mold with high temperature has a large thermal expansion, and the horizontal sliding mold is positioned by contacting the lower mold at its lower section. At this time, since the temperature of the horizontal sliding mold is low compared to the lower mold, its thermal expansion is small. As such, there are cases where the horizontal sliding mold is not able to contact the adjacent horizontal sliding mold. In such case, it is concerned that the horizontal sliding mold pushed in by the actuator becomes an inclined posture so as to fall down toward the center of the mold.

In order to prevent this, according to Japanese Patent Application Laid-open No. 2013-86118, supporting columns for preventing the inclining posture of the horizontal sliding mold are provided at a base to which the lower mold is fixed, so as to correspond to the four corners of the lower mold, thereby supporting the horizontal sliding mold by these supporting columns.

CITATION LIST

Patent Literature

Patent Literature 1: Japanese Patent Application Laid-open No. 2013-86118

SUMMARY OF INVENTION

Technical Problem

In the casting mold including supporting columns at the base to which the lower mold is fixed, although it is possible to prevent the inclination posture of the horizontal sliding mold, since it is necessary to provide the supporting columns at the base so as to correspond to the four corners of the lower mold, it is required to design the lower mold taking into account of the supporting columns, thereby causing the problem of decreasing the flexibility of design of the lower mold. Moreover, there are cases where the positions of the supporting columns need to be changed when changing the mold, and in such cases, it is necessary to also change the base.

In view of the above, it is an object of the present invention to provide a casting mold capable of preventing the inclination posture of the horizontal sliding mold without providing the supporting columns.

Solution to Problem

In order to achieve the above object, the present invention is a casting mold including: a lower mold fixed on a base; a plurality of horizontal sliding molds which slide freely on the base between a mold-opening position and a mold-closing position, an upper mold; and sliding mechanisms which slide the horizontal sliding molds in sliding directions, wherein the sliding mechanisms cause force to act on a lower section of the horizontal sliding molds and prevent force from acting on an upper section of the horizontal sliding molds, when sliding the horizontal sliding molds from the mold-opening position to the mold-closing position.

According to the present invention, since the force of the sliding mechanism is applied to the lower section of the horizontal sliding mold which slides on the base and the force is prevented from acting on the upper section of the horizontal sliding mold, the force of the sliding mechanism acts on the horizontal sliding mold at a portion close to the portion where friction is generated between the horizontal sliding mold and the base. Accordingly, the force applied to the horizontal sliding mold by the sliding mechanism acts on the position close to the position where friction occurs between the horizontal sliding mold and the base, in a state which is difficult for the horizontal sliding mold to fall to become the inclination state. According to this, the casting mold of the present invention is able to prevent the inclination posture of the horizontal sliding mold without providing any supporting columns at the lower mold, thereby enabling to improve the flexibility of design of the lower mold.

Moreover, according to the present invention, preferably, the sliding mechanisms cause force to act on a center section of the horizontal sliding molds, when sliding the horizontal sliding molds from the mold-closing position to the mold-opening position. According to such configuration, when releasing the molds by sliding the horizontal sliding molds from the mold-closing position to the mold-opening position, it is able to release the molds by applying force to the center section (including the center and the vicinity thereof) which is capable of transmitting the force to the horizontal sliding mold as a whole. By this, the casting mold of the present invention is able to prevent the horizontal sliding mold from being caught with the cast product when releasing the mold, thereby enabling smooth mold releasing.

Here, "causing force to act on the center section of the horizontal sliding mold" recited in the specification, is defined to include not only a state in which force is directly acted on the center section of the horizontal sliding mold, but also an indirect state in which a resultant force of a plurality of force acting on the horizontal sliding mold is positioned at the center section of the horizontal sliding mold (in other words, a state in which the force is distributed in good balance without the inclination of the horizontal sliding mold, a state in which the horizontal sliding mold does not incline by the adsorption force with the product (cast product) at the time of releasing the mold).

Moreover, according to the present invention, it is able to configure that one of the plurality of sliding mechanisms is a connecting rod type sliding mechanism which is configured to cause the force to act via four connecting rods each being provided at four corners of one of the horizontal sliding molds on which the force is to be acted, and which is arranged behind another horizontal sliding mold opposing the horizontal sliding mold on which the force is to be acted, the connecting rod type sliding mechanism is configured to transmit the force to the horizontal sliding mold on which the force is to be acted via only two of the four connecting rods provided at a lower side, when sliding the horizontal sliding mold on which the force is to be acted from the mold-opening position to the mold-closing position, and the connecting rod type sliding mechanism is configured to transmit the force to the horizontal sliding mold on which the force is to be acted via the four connecting rods, when sliding the horizontal sliding mold on which the force is to be acted from the mold-closing position to the mold-opening position.

According to such configuration, when releasing the mold, it is able to transmit the force of the connecting rod type sliding mechanism to the whole horizontal sliding mold with good balance in a state of the force being equally transmitted to the four corners of the horizontal sliding mold. By this, the casting mold of the present invention is able to prevent the horizontal sliding mold from being caught with the product (cast product) at the time of releasing the mold, thereby enabling smooth mold releasing.

DESCRIPTION OF EMBODIMENTS

An embodiment of a casting mold of the present invention is explained with reference to FIG. 1 to FIG. 3.

Figure 1:
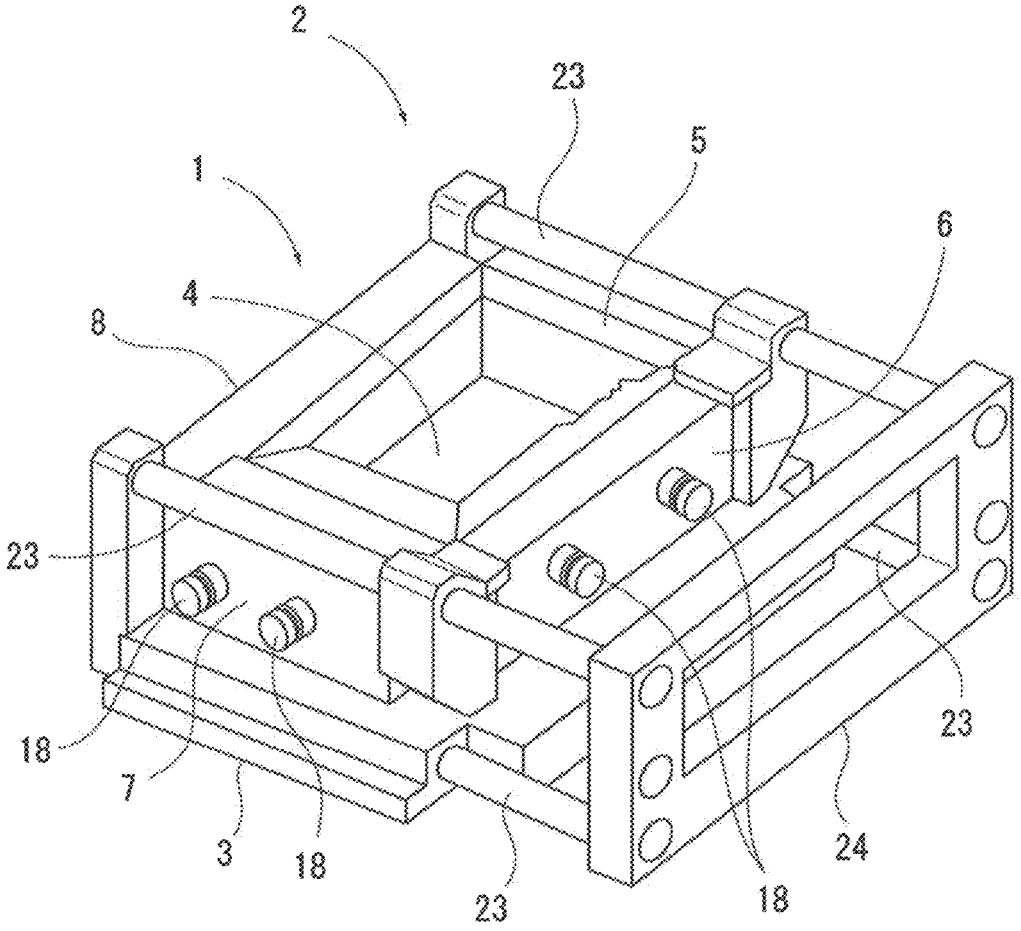
FIG. 1 is a perspective diagram schematically illustrating an embodiment of a casting mold of the present invention in which an upper mold is abbreviated.

Referring to FIG. 1, a casting mold 1 of the present embodiment configures the main part of a casting machine 2. The casting machine 2 is for casting a cylinder head of an engine for a vehicle by low pressure die casting method.

The casting machine 2 includes a base 3, and a mold 1 is arranged on the base 3. The mold 1 includes a lower mold 4 fixed on the base 3, first to fourth horizontal sliding molds 5 to 8 which are each arranged so as to surround the lower mold 4 from four side faces on the base 3, and an upper mold 9 arranged so as to cover the space defined by the lower mold 4 and the first to fourth horizontal sliding molds 5 to 8 from the upper side (refer to FIG. 2). The first to fourth horizontal sliding molds 5 to 8 are able to freely slide along a rail (not illustrated) provided on the base 3 from a mold-opening position to a mold-closing position. The lower mold 4 is provided with a sprue which is not illustrated. The base is provided with a molten metal furnace which is not illustrated. Molten metal is stored in the molten metal furnace, and by pressurizing the molten metal, the molten metal is supplied to the inside of the mold 1 via a stoke (supply conduit) through the sprue of the lower mold 4.

The lower mold 4 is formed in a rectangular shape in a plane view. An upper face of the lower mold 4 has a shape corresponding to a shape of a lower side of the product (cylinder head) to be casted. Inner faces of the first to fourth horizontal sliding molds 5 to 8 have a shape respectively corresponding to a shape of a side face of the product (cylinder head) to be casted.

Figure 2:
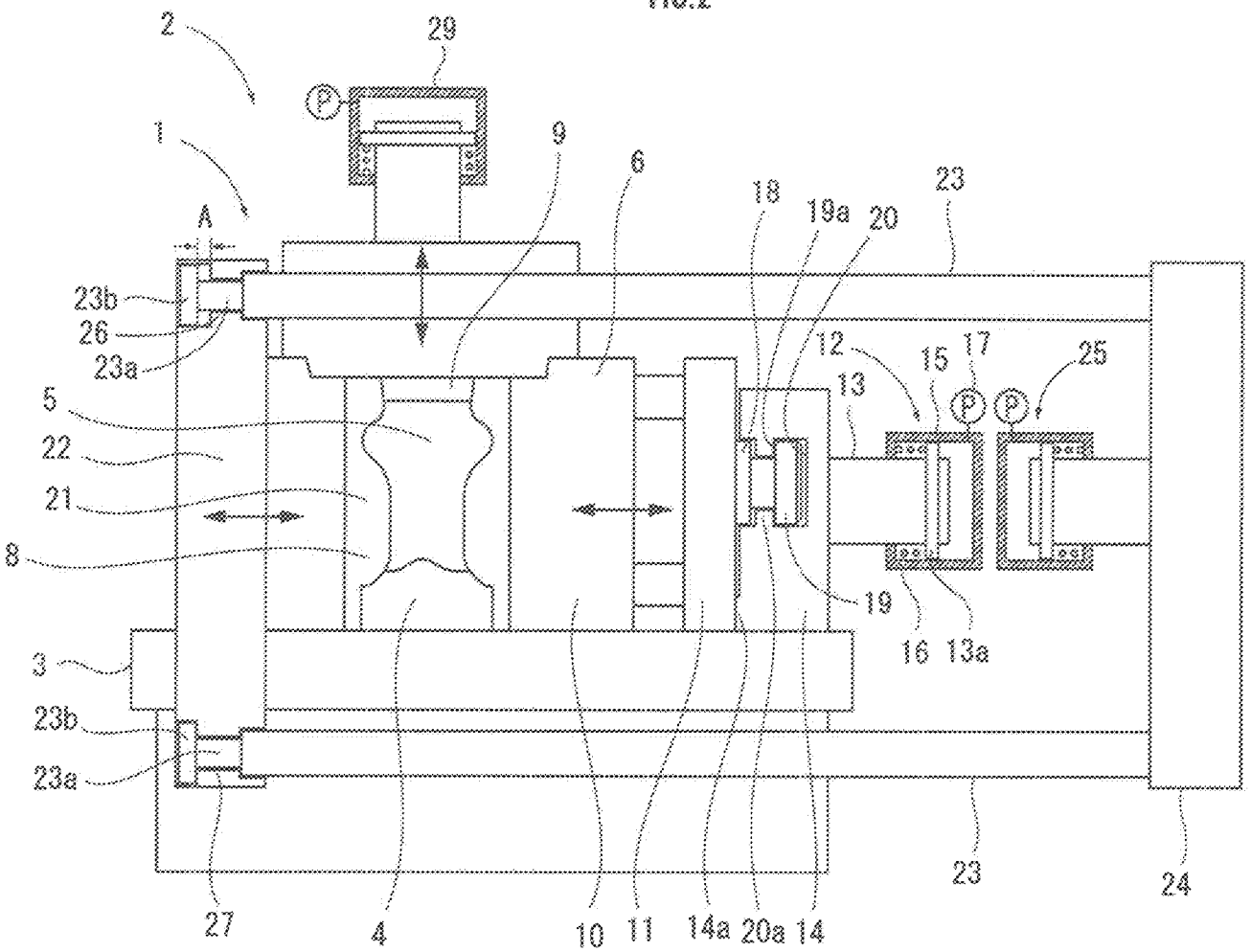
FIG. 2 is a cross-sectional diagram of a side view illustrating the casting mold of the present embodiment.

Referring to FIG. 2, the lower face of the upper mold 9 has a shape corresponding to a shape of an upper side of the product (cylinder head) to be casted.

The first to third horizontal sliding molds 5 to 7 respectively includes a mold body 10 having a surface shape corresponding to the product shape and a back plate 11 to which the mold body 10 is fixed. Behind the respective back plate 11, a sliding mechanism 12 configured by a linear actuator is arranged. The sliding mechanism 12 includes an advance-retreat member 13 which freely advances and retreats by hydraulic pressure, and a connecting member 14 which is provided at the end of the advance-retreat member 13 and which pushes and pulls the back plate 11.

A flange 13*a* which projects in a direction orthogonal with respect to the advance-retreat direction of the advance-retreat member 13, is provided at the rear end portion of the advance-retreat member 13. The rear end portion of the advance-retreat member 13 is housed in a cylinder 15. The flange 13*a* is biased rearward by a coil spring 16. Furthermore, a pump 17 is provided at the cylinder 15, which is capable of supplying oil to an inner space of the cylinder 15 at the rear side of the flange 13*a*, in a state the advance-retreat member 13 is positioned at the most rear side by the biasing force of the coil spring 16.

When hydraulic pressure stronger than the biasing force of the coil spring 16 is supplied inside the cylinder 15 from the pump 17, the advance-retreat member 13 slowly advances by the hydraulic pressure and becomes the mold-closing state. Thereafter, when the supply of hydraulic pressure from the pump 17 is stopped, the oil inside the cylinder 15 is slowly discharged from the outlet (not illustrated), and the advance-retreat member 13 slowly retreats by the biasing force of the coil spring 16 and becomes the mold-opening state.

A protruding section 14*a* which contacts the lower part of the back plate 11 is provided at the connecting member 14. An engaging protrusion portion 18 which extends rearward is provided at the back plate 11. At the rear end of the engaging protrusion portion 18, a head section 19 is provided which expands on a plane having an axis line of the advance-retreat direction of the advance-retreat member 13 as the perpendicular line.

A receiving hole 20 which receives the engaging protrusion portion 18 and the head section 19 is provided at the connecting member 14. An engaging pawl 20*a* which engages with an inner side surface 19*a* of the head section 19 is provided at the receiving hole 20.

When oil is supplied from the pump 17 to the inner space at the rear side of the flange 13*a* in the cylinder 15, the advance-retreat member 13 slowly advances. Then, the connecting member 14 also advances together with the advance-retreat member 13, and the lower part of the back plate 11 is pressed inward by the protruding section 14*a* provided at the lower part of the connecting member 14.

As such, by pressing the lower part of the back plate 11 and prohibiting the pressing of the upper part of the back plate 11, the first to third horizontal sliding molds 5 to 7 are pressed at a same portion at a lower end portion where the friction occurs or at the vicinity thereof. Accordingly, it is able to prevent the first to third horizontal sliding molds 5 to 7 to slide them from becoming the inclination posture without providing supporting columns for preventing the inclination posture of the horizontal sliding molds as the conventional case.

Moreover, when the sliding mechanism 12 pulls the first to third horizontal sliding molds 5 to 7 from the mold-closing position to the mold-opening position, the head section 19 of the engaging protrusion portion 18 engages with the engaging pawl 20*a* of the connecting member 14, and the first to third horizontal sliding molds 5 to 7 are pulled. As such, the position to which the force is transmit is differed between the time of pressing to move the molds to the mold-closing position and the time of pulling to move the molds to the mold-opening position. At the time of pulling to move the molds to the mold-opening position, since the center portion (including the center and the vicinity of the center) of the respective first to third horizontal sliding molds 5 to 7 is pulled, it is able to prevent the product (cast product) from being caught by the first to third horizontal sliding molds 5 to 7 when opening the mold.

Although pressing force is applied when moving the molds to the mold-closing position and pulling force is applied when moving the molds to the mold-opening position in the present embodiment, the present invention is not limited to this as long as the force is applied to the lower side of the horizontal sliding mold when closing the mold and the resultant force of the force is positioned at the center portion of the horizontal sliding mold when opening the mold. Therefore, for example, the effect of the present invention can also be obtained by applying pulling force to the horizontal sliding mold to slide the horizontal sliding mold to the mold-closing position when closing the mold, and by applying pressing force to the horizontal sliding mold to slide the horizontal sliding mold to the mold-opening position when opening the mold.

The forth horizontal sliding mold 8 is composed of a mold body 21 having a surface shape corresponding to the product shape and a rectangular shaped (oblong) back plate 22 to which the mold body 21 is fixed. At the four corners of the back plate 22, connecting rods 23 are respectively provided, extending toward the second horizontal sliding mold 6 side opposing the fourth horizontal sliding mold 8. At the end of the four connecting rods 23, one joining section 24 is provided and the connecting rods 23 are put together. A linear actuator 25 which is capable of freely pushing and pulling the joining section 24 is provided between the joining section 24 and the sliding mechanism 12 of the second horizontal sliding mold 6. The linear actuator 25 is configured similar to the sliding mechanism 12.

At one end of the four connecting rods 23 which is connected to the back plate 22, an annular groove 23*a* is provided. By providing this annular groove 23*a*, a large diameter end section 23*b* is formed at the one end of the four connecting rods 23.

At the back plate 22, upper fitting sections 26 are provided, each of which being fitted to the annular groove 23*a* of the two connecting rods 23 arranged at the upper side. Furthermore, at the back plate 22, lower fitting sections 27 are provided, each of which being fitted to the annular groove 23*a* of the two connecting rods 23 arranged at the lower side. The back plate 22 is pulled via the connecting rods 23 by pushing the joining section 24 by the linear actuator 25.

When the back plate 22 is pulled by the connecting rods 23, the upper fitting section 26 is configured so as to form a gap A between the upper fitting section 26 and the large diameter end sections 23*b* of the two connecting rods 23 arranged at the upper side, when the large diameter end sections 23*b* of the two connecting rods 23 arranged at the lower side engages with the lower fitting sections 27 so that force is transmitted to the back plate 22 via only the two connecting rods 23 arranged at the lower side.

On the other hand, when the joining section 24 is pulled by the linear actuator 25, the back plate 22 is pressed toward the mold-opening position via the connecting rods 23. At this time, the fitting sections 26, 27 and the annular groove 23*a* are engaged so that the back plate 22 is pushed via all of the four connecting rods 23.

By this, force is applied only to the lower section of the fourth horizontal sliding mold 8 when sliding the fourth horizontal sliding mold 8 to the mold-closing position, thus preventing the fourth horizontal sliding mold 8 from becoming the inclination posture even without the supporting columns.

Moreover, when sliding the fourth horizontal sliding mold 8 to the mold-opening position, since the motive power is transmitted to the back plate 22 via all four connecting rods 23, the resultant force of the force transmitted to the back plate 22 from the four connecting rods 23 acts on the center portion (center or the vicinity of center), thereby enabling to appropriately retreat the fourth horizontal sliding mold 8 with respect to the mold releasing force generated when opening the mold. According to this, the fourth horizontal sliding mold 8 is prevented from being caught with the product (cast product) when opening the mold, thereby enabling smooth mold release.

In the present embodiment, a connecting rod type sliding mechanism is configured by the connecting rods 23, the joining section 24, the linear actuator 25, the upper fitting section 26, and the lower fitting section 27.

The upper mold 9 is freely elevated between the mold-opening position and the mold-closing position by a lifting device 29 which is configured similar to the sliding mechanism 12.

In the present embodiment, explanation has been given for a configuration in which the gap A is provided between the fourth horizontal sliding mold 8 and the two connecting rods 23 at the upper side so as to prevent force transmission, when sliding the fourth horizontal sliding mold 8 from the mold-opening position to the mold-closing position. However, the configuration of the present invention is not limited to this. For example, the same effect of the present invention can be obtained by providing a gap between the joining section 24 and the two connecting rods 23 arranged at the upper side so as to prevent force by hydraulic pressure from being transmitted, when sliding the fourth horizontal sliding mold 8 from the mold-opening position to the mold-closing position.

Figure 3:
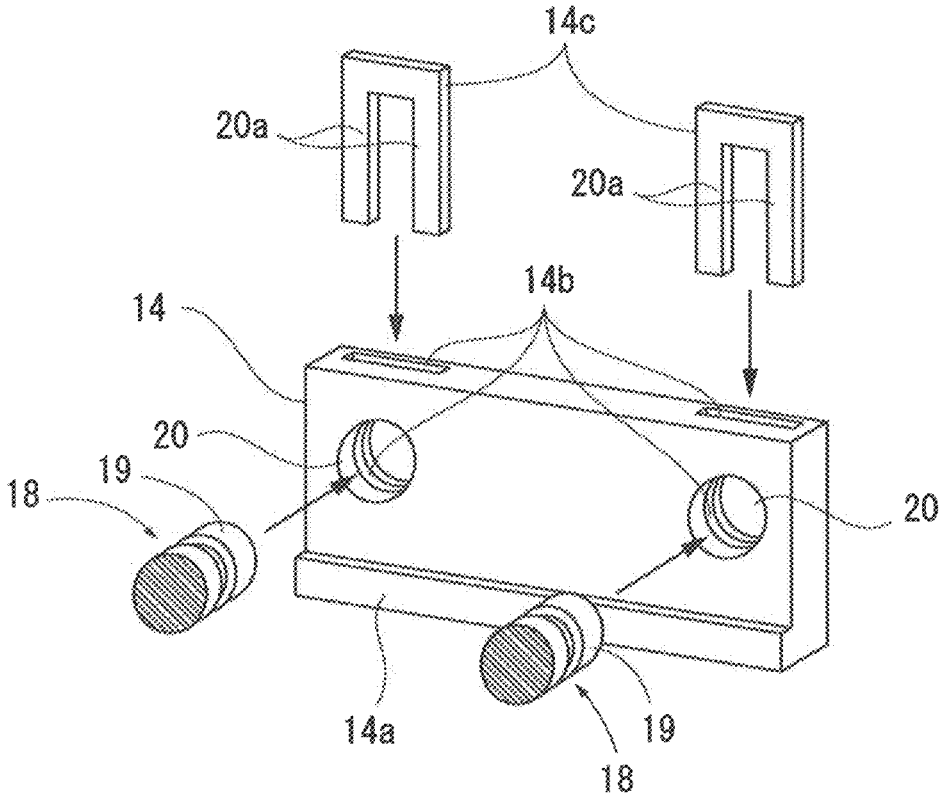
FIG. 3 is an explanatory diagram illustrating a sliding mechanism of the present embodiment.

FIG. 3 illustrates an engaging structure of the head section 19 and the engaging pawl 20*a*. A slit 14*b* is provided at the connecting member 14 in a direction orthogonal to the axis line of the boring direction of the receiving hole 20. The slit 14*b* is provided so as to face the receiving hole 20. By inserting the two-forked shape pin member 14*c* into the slit 14*b* so as to straddle the engaging protrusion portion 18, a part of the pin member 14*c* functions as the engaging pawl 20*a* which engages with the head section 19.

Figure 4:
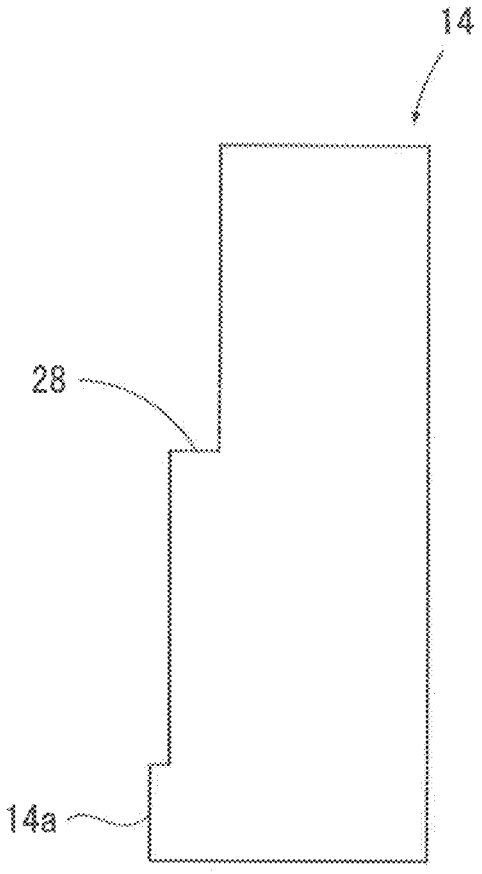
FIG. 4 is an explanatory diagram illustrating another embodiment of a casting mold of the present invention.

FIG. 4 illustrates another embodiment of the connecting member 14. The upper portion of the connecting member 14 excluding the portion provided with the protruding section 14*a*, is not limited to the embodiment shown in FIG. 1 to FIG. 3, but may be provided with a step 28 so that the interval with the back plate 11 widens towards the upper side as shown in FIG. 4. Moreover, the connecting member 14 is not limited to the one shown in FIG. 4, but the upper portion of the connecting member 14 excluding the portion provided with the protruding section 14*a*, may be an inclination face which inclines so that the interval with the back plate 11 gradually widens as approaching the upper side.

Moreover, although the present embodiment explains the casing mold using the linear actuator 25, the casting mold of the present invention is not limited thereto, and the effect of the present invention can be obtained by using the sliding mechanism 12 instead of the linear actuator 25 to prevent the fourth horizontal sliding mold 8 from being caught with the product (cast product) when opening the mold, thereby enabling smooth mold release.

Moreover, the present embodiment explains the configuration in which right and left pair of engaging protrusion portions 18 are provided to engage with the connecting member 14, so that the resultant force of the force acting on the first to third horizontal sliding molds 5 to 7 via the pair of engaging protrusion portions 18 when releasing the mold, is acted on the center portion (including the center and the vicinity thereof) of the respective first to third horizontal sliding molds 5 to 7.

However, the casting mold of the present invention is not limited to this, and the position and the number of engaging protrusion portions may be arbitrarily changed according to the product shape (cast product shape) as long as it is configured so that the resultant force of the force when releasing the mold is acted on the center portion of the horizontal sliding mold. For example, only one engaging protrusion portion may be provided at the center portion (including the center and the vicinity thereof) of the horizontal sliding mold, or it may be configured to arrange six engaging protrusion portions well-balanced on the horizontal sliding mold so that the resultant force of the force acting via the engaging protrusion portion is positioned at the center portion of the horizontal sliding mold.

In the present specification, "acting force on the center portion of the horizontal sliding mold" is defined to include not only acting force directly on the center portion of the horizontal sliding mold, but also an indirect state in which the resultant force of a plurality of force acting on the horizontal sliding mold is positioned at the center portion of the horizontal sliding mold (in other words, a state in which the horizontal sliding mold does not incline and the force is distributed in good balance, a state in which the horizontal sliding mold does not incline by the adsorption power with the product (cast product) when releasing the mold).

DESCRIPTION OF REFERENCE NUMERALS

1 casting mold
2 casting machine
3 base
4 lower mold
5 first horizontal sliding mold
6 second horizontal sliding mold
7 third horizontal sliding mold
8 fourth horizontal sliding mold
9 upper mold
10 mold body
11 back plate
12 sliding mechanism
13 advance-retreat member
13*a* flange
14 connecting member
14*a* protruding section
14*b* slit
14*c* pin member
15 cylinder
16 coil spring
17 pump
18 engaging protrusion portion
19 head section
19*a* inner side surface
20 receiving hole
20*a* engaging pawl
21 mold body
22 back plate
23 connecting rod
23*a* annular groove
23*b* large diameter end section
24 joining section
25 linear actuator (connecting rod type sliding mechanism)
26 upper fitting section
27 lower fitting section
28 step
29 lifting device
A gap

The invention claimed is:

1. A casting mold comprising:
a lower mold fixed on a base;
a plurality of horizontal sliding molds which slide freely on the base between a mold-opening position and a mold-closing position,
an upper mold; and
sliding mechanisms which slide the horizontal sliding molds in sliding directions,
wherein the sliding mechanisms cause force to act on a lower section of the horizontal sliding molds and prevent force from acting on an upper section of the horizontal sliding molds, when sliding the horizontal sliding molds from the mold-opening position to the mold-closing position.

2. The casting mold according to claim 1,
wherein the sliding mechanisms cause force to act on a center section of the horizontal sliding molds, when sliding the horizontal sliding molds from the mold-closing position to the mold-opening position.

3. The casting mold according to claim 2, wherein,
one of the plurality of sliding mechanisms is a connecting rod type sliding mechanism which is configured to cause the force to act via four connecting rods each being provided at four corners of one of the horizontal sliding molds on which the force is to be acted, and which is arranged behind another horizontal sliding mold opposing the horizontal sliding mold on which the force is to be acted,
the connecting rod type sliding mechanism is configured to transmit the force to the horizontal sliding mold on which the force is to be acted via only two of the four connecting rods provided at a lower side, when sliding the horizontal sliding mold on which the force is to be acted from the mold-opening position to the mold-closing position, and the connecting rod type sliding mechanism is configured to transmit the force to the horizontal sliding mold on which the force is to be acted via the four connecting rods, when sliding the horizontal sliding mold on which the force is to be acted from the mold-closing position to the mold-opening position.

4. The casting mold according to claim 1, wherein one of the plurality of sliding mechanisms is a connecting rod type sliding mechanism which is configured to cause the force to act via four connecting rods each being provided at four corners of one of the horizontal sliding molds on which the force is to be acted, and which is arranged behind another horizontal sliding mold opposing the horizontal sliding mold on which the force is to be acted, the connecting rod type sliding mechanism is configured to transmit the force to the horizontal sliding mold on which the force is to be acted via only two of the four connecting rods provided at a lower side, when sliding the horizontal sliding mold on which the force is to be acted from the mold-opening position to the mold-closing position, and the connecting rod type sliding mechanism is configured to transmit the force to the horizontal sliding mold on which the force is to be acted via the four connecting rods when sliding the horizontal sliding mold on which the force is to be acted from the mold-closing position to the mold-opening position.

* * * * *